US006739940B2

(12) United States Patent
Chuang

(10) Patent No.: US 6,739,940 B2
(45) Date of Patent: May 25, 2004

(54) SQUEEZABLE ELASTIC TOY

(76) Inventor: Chia-Chien Chuang, 3F, No.12, Alley 141, Sec. 2, Ta An Rd., Taipei City (TW)

( * ) Notice: Subject to any disclaimer, the term of this patent is extended or adjusted under 35 U.S.C. 154(b) by 11 days.

(21) Appl. No.: 10/205,462

(22) Filed: Jul. 26, 2002

(65) Prior Publication Data

US 2004/0018798 A1 Jan. 29, 2004

(51) Int. Cl.[7] ..... A63H 3/00
(52) U.S. Cl. ..... 446/325; 446/373; 446/385
(58) Field of Search ..... 446/97, 268, 320, 446/325, 326, 373, 385, 396, 370

(56) References Cited

U.S. PATENT DOCUMENTS 3,699,715 A * 10/1972 Lewis et al. ..... 446/376
4,136,484 A * 1/1979 Abrams ..... 446/370
4,341,036 A * 7/1982 Yeu ..... 446/385
4,758,195 A * 7/1988 Walsh ..... 446/85
5,288,257 A * 2/1994 Zacherl ..... 446/72
5,310,380 A * 5/1994 Levy et al. ..... 446/489
5,498,190 A * 3/1996 Ganson ..... 446/107
5,762,531 A * 6/1998 Witkin ..... 446/374

* cited by examiner

*Primary Examiner*—Jacob K. Ackun, Jr.
(74) *Attorney, Agent, or Firm*—Troxell Law Office PLLC

(57) ABSTRACT

A squeezable elastic toy is formed from a soft resilient material, such as foamed polyurethane, and has a suitable height to stand upright. A supporting member having a sufficient elastic resilience is disposed in the toy, so that the toy freely deforms when being squeezed and quickly recovers from deformation when being released. The toy may be fixedly attached to an article at any surface thereof by attaching, for example, a double-side adhesive tape to a bottom of the toy, so that the toy may be stroke or patted to swing a head portion thereof without falling down. The toy may have a variety of appearances and allows a user to freely squeeze or strike it and therefore serves as a good ornament as well as a good vent of feelings.

1 Claim, 3 Drawing Sheets

SQUEEZABLE ELASTIC TOY

BACKGROUND OF THE INVENTION

The present invention relates to a squeezable elastic toy, and more particularly to a squeezable elastic toy that is made of a soft elastic material and supported by an internal flexible supporting member to stand upright, so that it may be freely squeezed or stroke by a user and quickly recovers from deformation to serve as a good ornament and vent of feelings.

There is a soft, elastic, and squeezable toy made of a foamed polyurethane material available in the market and being used as a vent of feelings. The toy may have a variety of appearances, such as an ox, a sheep, or other animals, or an eyeball, a heart, or other organs. Such squeezable toy usually has a size close to a human palm, so that a user may hold it with one hand to squeeze it as wish. The toy deforms or is compressed whenever it is squeezed and therefore serves as a good vent of feelings for the user, and it quickly recovers from deformation or compression when it is released. There is another type of swing toy that allows a user to freely strike or hit it. This type of swing toy usually has a big volume and is provided with a weight for positioning on the ground without easily tumbling.

The swing toy serves as a tumbler to always return to an upright position after it is forcedly stroke or hit. The conventional squeeze toy and swing toy are different from each other in materials and structures thereof. It is therefore desirable to develop a novel toy that combines the squeeze and swing toys to create much more fun in squeezing and striking the toy.

SUMMARY OF THE INVENTION

A primary object of the present invention is to provide a squeezable elastic toy that is formed from a soft resilient material, such as foamed polyurethane, into a suitable height to stand upright. A flexible supporting member is embedded in the upright toy, so that the toy is squeezable to deform and swings when being stroke with fingers, and serves as a vent of feelings in two manners.

Another object of the present invention is to provide a squeezable elastic toy that has a double-side adhesive tape attached to a base bottom thereof and can therefore be conveniently fixed to an article at any surface thereof, such as a desktop, an upper or a side surface of an armrest, etc., so that a user may play it at any time.

A further object of the present invention is to provide a squeezable elastic toy that may be differently designed to have a variety of appearances and provides consumers with more choices, so that it serves not only as a vent of feelings, but also a good desktop ornament.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
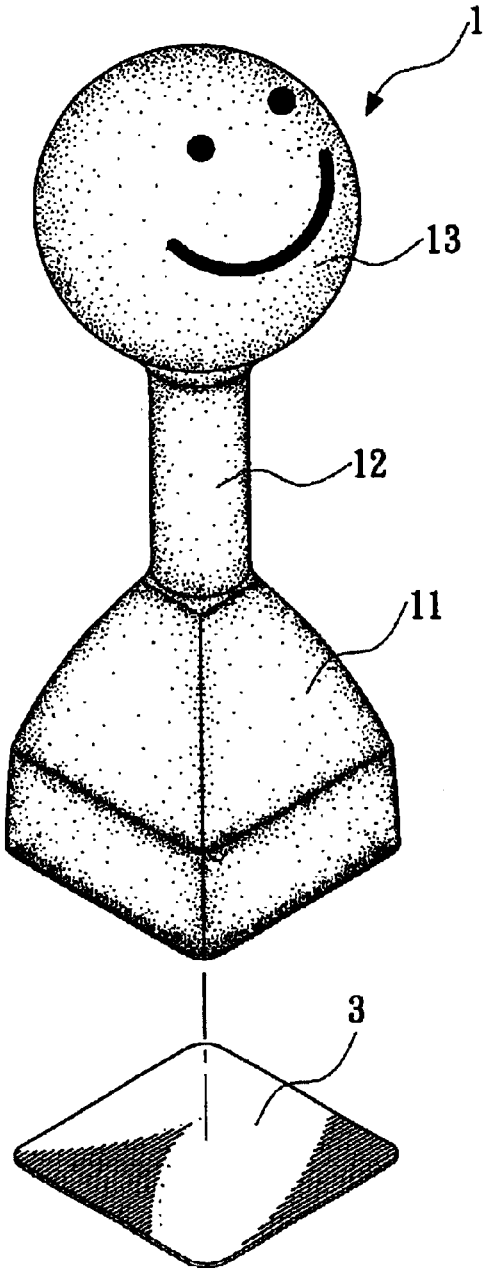
FIG. 1 is a perspective view of a squeezable elastic toy according to an embodiment of the present invention.

Please refer to FIG. 1 that is a perspective view of a squeezable elastic toy according to an embodiment of the present invention. The squeezable elastic toy has a main body 1 that is integrally formed from a soft elastic material, such as foamed polyurethane (PU) with a suitable foam density, so that it is readily deformed when being squeezed and able to recover quickly and freely from squeezing. The main body 1 of the squeezable elastic toy may have an overall height or size properly decided depending on a use intended for it. For example, it may be 12 cm to 15 cm in height for suitably positioning on a desktop.

Figure 2:
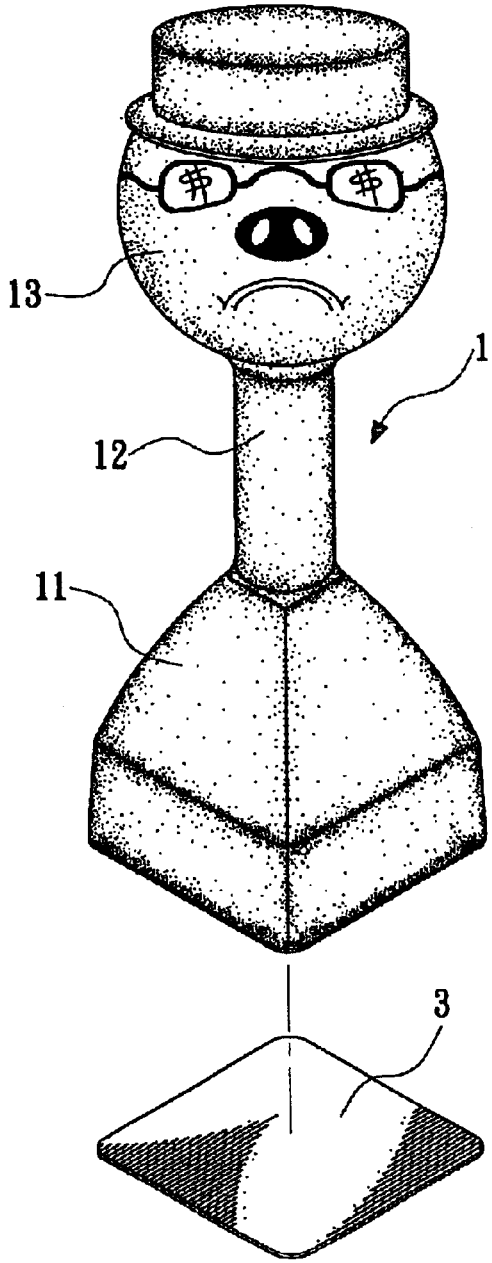
FIG. 2 is a squeezable elastic toy structurally similar to that of FIG. 1 but showing a different appearance.
Figure 3A:
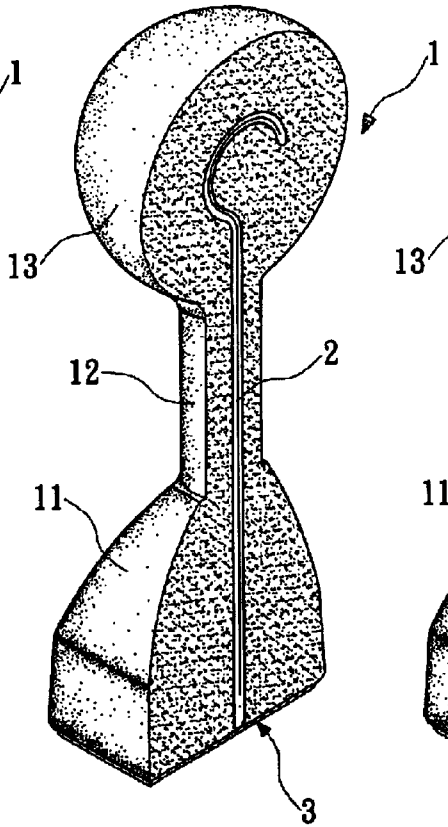
FIG. 3A is a sectioned view of FIG. 3.
Figure 3:
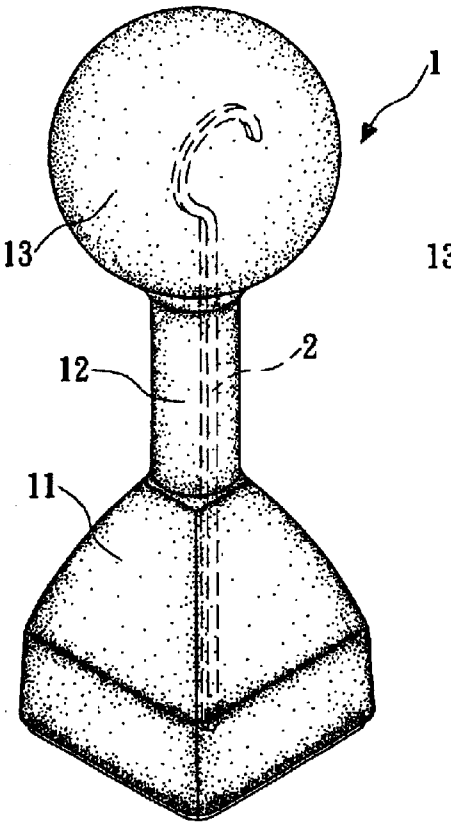
FIG. 3 is a perspective view showing the squeezable elastic toy of FIG. 1 is internally provided with a flexible supporting member in a first shape.

As shown in FIGS. 3 and 3A, the main body 1 is internally provided with a supporting member 2 that may be made of a plastic or a metal material to have sufficient toughness and elastic resilience. The supporting member 2 is completely enclosed in the main body 1, and is therefore not easily bent or deformed or projected from the main body 1. The supporting member 2 has a length long enough for upward extending it from a base 11 of the main body 1 through a middle section 12 to a head portion 13, so that the main body 1 formed from the soft foam material without sufficient supporting strength is now well supported by the supporting member 2 to stand upright. The main body 1 may be differently designed to show a variety of appearances to provide consumers with multiple choices. For example, the head portion 13 may present a figurative design to increase its ornamental function; the middle section 12 is located between the head portion 13 and the base 11 to form a narrowed waist portion to enable a highly active swing of the head portion 13; and the base 11 serves as a supporting point for the swinging head portion 13. FIG. 2 shows a squeezable elastic toy that is structurally similar to the one of FIG. 1 but with a differently designed head portion 13. A double-side adhesive tape 3 may be attached to a bottom side of the base 11 for conveniently adhering the toy to any surface, such as a tabletop, an upper or a side surface of an armrest, etc. Since the whole main body 1 is formed from a soft elastic material, it would not create an impediment to a user even it is unexpectedly collided.

The squeezable elastic toy 1 may be positioned on a desktop when a user is operating a computer. The user may grip the toy 1 at its head portion 13 or hold the entire toy 1 to squeeze it in any manner as wish and at any time, such as at a break during work, or at a moment feeling depressed or frustrated. The soft elastic material allows the main body 1 to freely deform when being squeezed and to quickly recover from the squeezing when being released. The user may strike the head portion 13 with fingers while alternately squeezes and releases the toy 1, so that the head portion 13 swings like a suspended punching bag for practicing boxing. The user may then suitably find a vent in the squeezable elastic toy 1.

Figure 5:
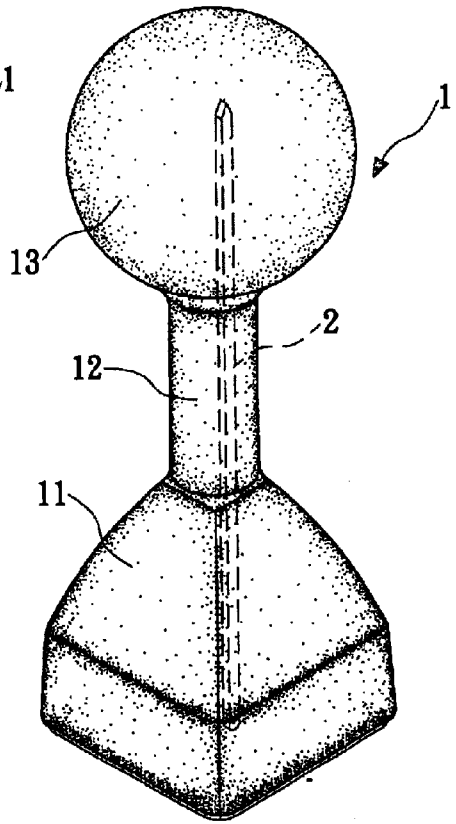
FIG. 5 is a perspective view showing the squeezable elastic toy of FIG. 1 is internally provided with a flexible supporting member in a third shape.
Figure 4:
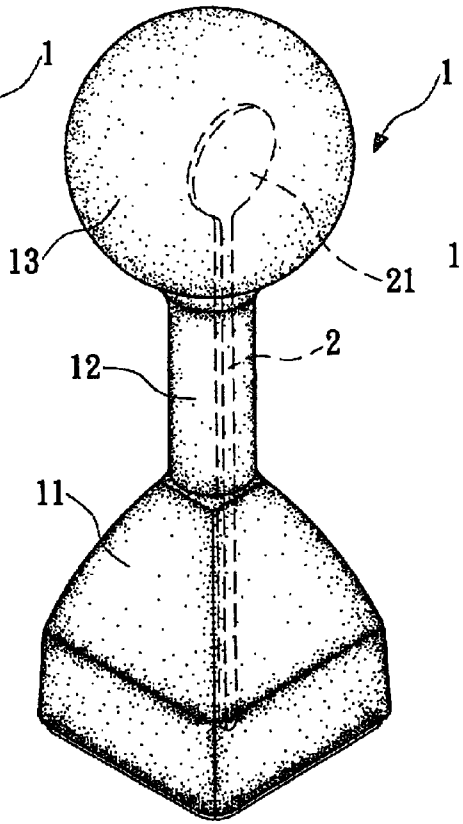
FIG. 4 is a perspective view showing the squeezable elastic toy of FIG. 1 is internally provided with a flexible supporting member in a second shape.

The supporting member 2 is made of a plastic or metal material and is generally in the form of a thin strip or bar, so that it would not limit the main body 1 enclosing it to swing in a certain fixed direction. In manufacturing the main body 1, the supporting member 2 is pre-positioned in a mould to be integrally formed along with the main body 1. In this case, the supporting member 2 may have a head 21 with an increased width and accordingly a large area to enable an enhanced bonding strength between it and the foam material of the main body 1. Alternatively, the supporting member 2 may be extended from the bottom of the base 11 into the main body 1 after the latter is molded, as shown in FIG. 5. It is preferable the supporting member 2 is located in a vertical central axis of the main body 1 to be evenly enclosed at all areas by a proper thickness of the foam material, so that a user's hand is not in contact with the supporting member 2 or a pointed tail thereof when the toy 1 is squeezed with the hand.

Figure 6:
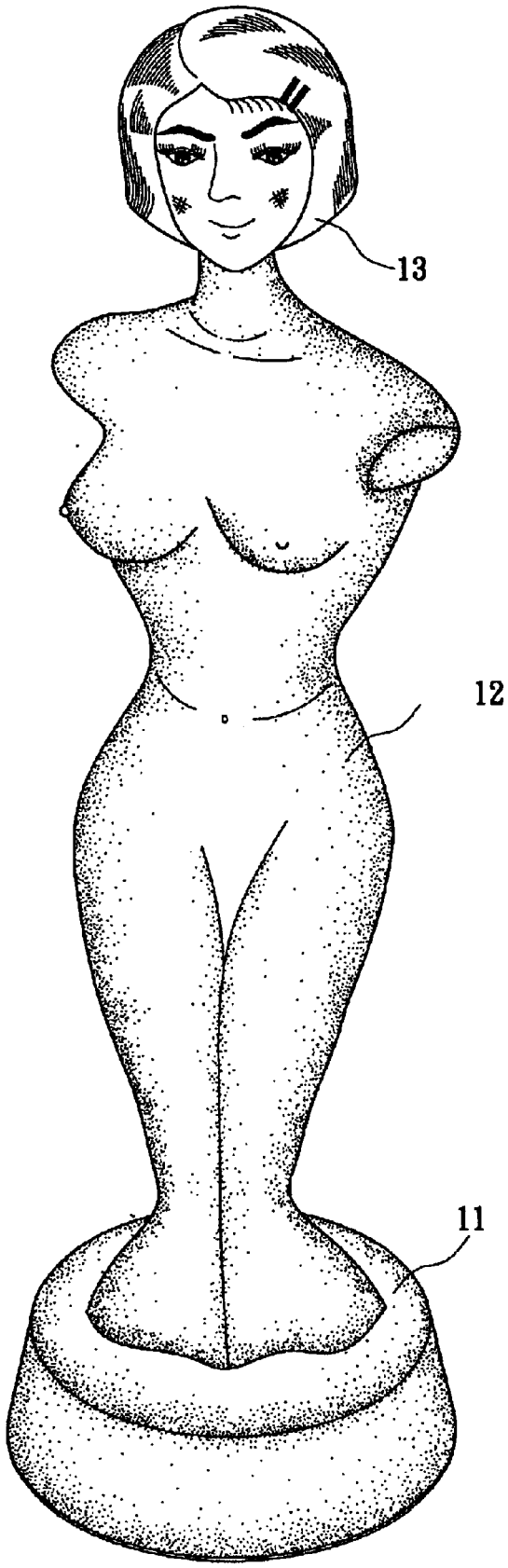
FIG. 6 is a perspective view of a squeezable elastic toy of the present invention showing another different appearance.

The main body 1 made of a foam material may be differently designed to show a variety of appearances. Nevertheless, the main body 1 is preferably so shaped that it always includes a base 11, a narrowed middle section 12, and a head portion 13 to enable the main body 1 to actively swing when it is stroke with fingers. FIG. 6 shows a squeezable elastic toy in the shape of a beauty, a slim waist of which constitutes the narrowed middle section 12 of the toy 1.

Although the present invention employs considerably simple technical means, it creates a novel and improved product among the squeezable toys.

What is claimed is:

1. A squeezable elastic toy comprising:

a main body having base portion having a flat bottom surface to support the main body on a support surface; a middle section extending upwardly from the base portion; and a head portion on an uppermost extremity of the middle section, the main body being made of a foam material;

a supporting member located internally in the main body and extending through the base portion, the middle portion and into the head portion, the supporting member made of resilient material such that, when the main body and supporting member are deformed by external force, they return to a previous shape when the external force is removed; and a double sided adhesive tape adjoined to the flat bottom surface of the main body for adhering the main body to a support surface.

* * * * *